US006702490B2

(12) United States Patent
Sasaki

(10) Patent No.: US 6,702,490 B2
(45) Date of Patent: Mar. 9, 2004

(54) IMAGE RECORDING APPARATUS

(75) Inventor: Yoshiharu Sasaki, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/873,376

(22) Filed: Jun. 5, 2001

(65) Prior Publication Data

US 2001/0048834 A1 Dec. 6, 2001

(30) Foreign Application Priority Data

Jun. 6, 2000 (JP) ..... P2000-169201

(51) Int. Cl.[7] ..... B41J 35/28

(52) U.S. Cl. ..... 400/208; 400/208.1; 400/207; 347/176

(58) Field of Search ..... 400/208, 208.1, 400/207, 120.03, 120.04; 347/175, 176

(56) References Cited

U.S. PATENT DOCUMENTS

| | | | | | |
|---|---|---|---|---|---|
| 4,015,799 | A | * | 4/1977 | Koski et al. | 242/334.4 |
| 5,215,852 | A | * | 6/1993 | Kato et al. | 430/126 |
| 5,393,638 | A | * | 2/1995 | Mouri et al. | 430/201 |
| 5,663,755 | A | * | 9/1997 | Wada et al. | 347/176 |
| 5,826,995 | A | * | 10/1998 | Day et al. | 400/615.2 |
| 6,024,019 | A | * | 2/2000 | Williams et al. | 101/463.1 |
| 6,183,933 | B1 | * | 2/2001 | Ishikawa et al. | 430/256 |
| 6,283,652 | B1 | * | 9/2001 | Sasaki et al. | 400/208 |

FOREIGN PATENT DOCUMENTS

| | | | | |
|---|---|---|---|---|
| JP | 2001-63839 | A * | 6/1990 | |
| JP | 4-296594 | | 10/1992 | B41M/5/40 |
| JP | 4-327982 | | 11/1992 | B41M/5/26 |
| JP | 4-327983 | | 11/1992 | B41M/5/26 |
| JP | 7-290731 | | 11/1995 | B41J/2/32 |
| JP | 10167559 | A * | 6/1998 | B65H/39/16 |
| JP | 2000-267272 | | 9/2000 | G03F/7/004 |

OTHER PUBLICATIONS

English language Abstract. 4–296594. Oct. 20, 1992.
English language Abstract. 4–327982. Nov. 17, 1992.
English language Abstract. 4–327983. Nov. 17, 1992.
Patent Abstracts of Japan. 07–290731. Nov. 7, 1995.
Patent Abstracts of Japan. 2000–267272. Sep. 29, 2000.

* cited by examiner

*Primary Examiner*—Andrew H. Hirshfeld
*Assistant Examiner*—Minh H. Chau
(74) *Attorney, Agent, or Firm*—Sughrue Mion, PLLC

(57) ABSTRACT

A recording medium station 53 includes sheet set portions to which rolls of toner sheets 4' with cover films 6 stuck thereto and rolls of image receiving sheets 2' with cover films 6 stuck thereto are set, and cover film winding-up portions located close to the sheet set portions. Those sheet set portions and the cover film winding-up portions are disposed along the circumferential outer surface of the recording medium station 53. An end of the cover film 6 slightly stripped off the recording medium is fixed to the wind-up shafts 12, and the cover film 6 stripped off the recording medium set to the medium setting shafts 10 is wound up with a wind-up shaft 12. The stripped cover film 6 is wound up with the wind-up shafts 12.

5 Claims, 7 Drawing Sheets

PHOTON MODE

HEAT MODE

FIG. 8( f )

PHOTON MODE

HEAT MODE

IMAGE RECORDING APPARATUS

BACKGROUND OF THE INVENTION

1. Field of the Invention

The present invention relates to an image recording apparatus in which a toner sheet is located on an image receiving sheet, and the toner sheet is irradiated with light or heated to transfer toner from the toner sheet to the image receiving sheet. More particularly, the invention relates to an image recording apparatus which may handle a recording medium with a protecting sheet stuck thereto.

2. Description of the Related Art

A schematic illustration of an overall mechanical arrangement of a conventional image recording apparatus is shown in FIG. 7. In the figure, to form a full color image, the image recording apparatus designated by reference numeral 30 is composed of a recording-medium supplying section 32, a rotary drum 34, a recording-medium fixing/releasing mechanism 36, a laminating mechanism 38 disposed around the circumferential outer surface of the rotary drum 34, an optical head 40, a stripping-off mechanism 42, a sheet supply section 44, a laminating section 46, a fixing section 48, a stripping-off section 50, a tray section 52, and a control unit 51.

In the image recording apparatus, an image receiving sheet 2 is fixed on a recording rotary drum (referred to as a "rotary drum") 34, and a toner sheet 4 is fixed onto the image receiving sheet 2 while covering the latter (the image receiving sheet 2 and the toner sheet 4 will be referred to generally as "recording media"). A laser beam or the like emitted from the optical head is irradiated on the toner sheet to record an image thereon.

In the image recording apparatus 30, an image receiving sheet 2 and a toner sheet 4 are supplied onto the rotary drum 34 from the recording-medium supplying section 32. The image receiving sheet 2 is fixed onto the rotary drum 34 by the recording-medium fixing/releasing mechanism 36. Then, the toner sheet 4 is pressed against the image receiving sheet 2 and heated by the laminating mechanism 38, whereby the toner sheet 4 is stuck and laminated onto the image receiving sheet 2. This heating step is unnecessary when some types of the recording media 2 and 4 are used.

Then, the toner sheet is subjected to a heat mode laser imagewise exposure by the optical head 40, which is controlled, by a control unit 51, in accordance with an image signal, so that an image is recorded as a latent image in the toner sheet. Subsequently, the toner sheet 4 is stripped off the image receiving sheet 2 fixed to the rotary drum 34 by means of the stripping-off mechanism 42. The image recorded, which is recorded as a latent image in the toner sheet 4, is transferred from the toner sheet 4 to the image receiving sheet 2.

The sequential process is repeated for each color to form a color image on the image receiving sheet 2, and then the image receiving sheet 2 is placed on and brought into close contact with paper H supplied form the sheet supply section 44 in the laminating section 46. After an image receiving layer 16 on the image receiving sheet 2 is photoset by the fixing section 48, it is stripped from the paper H by the stripping-off section 50, and the paper H having a full color image formed thereon is discharged into a proof tray 52*a* and the used image receiving sheet 2 is discharged into a used-member stacker 52*b*.

In this way, the full color image can be produced as a hard copy.

The recording-medium supplying section 32 is made up of a recording medium station 53, a pair of pull-out rollers 54, a cutter 55, a pair of rollers 56, and a guide 57. The recording medium station 53 holds therein recording media 2 and 4 (i.e., a rolled image receiving sheet 2, and a plurality of toner sheets 4, such as standard toner sheets of K (black), C (cyan), M (magenta) and Y (yellow), or a rolled thermosensitive material, such as special sheets of gold, silver or the like, used in the field of printing). The paired pull-out rollers 54 are used for pulling out one recording medium 2 or 4. The cutter 55 is used for cutting the recording medium 2 (4) of a predetermined length, which is pulled out of the recording medium station 53, into a sheet-like recording medium. The paired rollers 56 transfer the sheet-like image receiving sheet 2 (4) while nip it therebetween. The guide 57 guides the sheet-like image receiving sheet 2 (4) onto the rotary drum 34, and guides the leading end of the recording medium 2 (4) to a fixing position of the recording-medium fixing/releasing mechanism 36, which is mounted on the rotary drum 34.

The image receiving sheet 2 is first supplied to the rotary drum 34. The leading end of it is fixed tot he recording-medium fixing/releasing mechanism 36 by means of clamping means, and is wound on the outer surface of the rotary drum 34, and the trailing end of it is also fixed to the recording-medium fixing/releasing mechanism 36. At least one of the leading end fixing part and the trailing end fixing part of the recording-medium fixing/releasing mechanism 36 is preferably movable on the outer surface of the rotary drum 34. If so done, the recording medium sheets of various lengths may be fixed onto the rotary drum 34.

Then, a toner sheet 4, which has been transported from the recording-medium supplying section 32, is wound on the toner sheet 4 on the image receiving sheet 2 wound on the outer surface of the rotary drum 34, in the same manner. The toner sheet 4 is laminated on the image receiving sheet 2 by the laminating mechanism 38, which is made up of a laminate roller 58 containing a heater (not shown) therein, an arm 59 which turns the laminate roller 58 about a fulcrum 59*a* to touch and separate from the outer surface of the rotary drum 34, and a pressing means 60 for pressing the laminate roller 58 against the rotary drum 34 by a predetermined pressing force. The pressing means 60 may be urging means, such as a spring, or a manipulator of an air cylinder.

A receiving layer, or an outermost layer, of the image receiving sheet 2 has a viscosity. Accordingly, the toner sheet may be laminated on the image receiving sheet 2 in a manner that the toner sheet is pressed against the image receiving sheet at a predetermined pressure by the laminate roller 58. Therefore, there is no chance of creasing the toner sheet 4. Further, the image receiving layer of the image receiving sheet 2 may be bonded to the toner layer of the toner sheet 4 at uniform adhesive power.

It is necessary to uniformly and strongly bond the toner sheet 4 to the image receiving sheet 2 for their laminate. To this end, the laminate roller 58 is used for the lamination. To increase the adhesive power, it is preferable that in carrying out the lamination of them, a pressure is applied to them by the laminate roller 58 and while at the same time those are heated. In this case, a temperature for the heating is preferably within 130° C. or lower or 100° C. or lower.

A preferable manner to wind the image receiving sheet 2 on the rotary drum 34 is such that the leading end of the image receiving sheet 2 is fixed to the rotary drum by the recording-medium fixing/releasing mechanism 36, the other part of the image receiving sheet is held with the paired rollers 56, the laminate roller 58 or another means, and the image receiving sheet 2 is wound on the rotary drum 34 in a state that the image receiving sheet 2 is stretched at a predetermined tension. At this time, as will be described later, suction holes are formed in the outer surface of the rotary drum 34, and the image receiving sheet 2 is attracted to the rotary drum by use of suction means. The suction means and the recording-medium fixing/releasing mechanism 36 are preferably constructed in the form of a single unit, but either of them may be used as a matter of course. By so doing, the image receiving sheet 2 may be fixed to the outer surface of the rotary drum 34 while being free from creasing of the image receiving sheet 2 and its shifting in position. Further, it is preferable to tension the toner sheet 4 also when the toner sheet 4 is laminated on the image receiving sheet 2. As in winding the image receiving sheet 2, the leading end and the trailing end of the toner sheet 4 may be fixed by use of the recording-medium fixing/releasing mechanism 36. The suction means may also be used in this case. A tension to be exerted on the toner sheet 4 at the time of its laminating process is preferably smaller than that to be exerted on the image receiving sheet 2 when it is wound on the rotary drum 34.

The optical head 40 is made up of modulating means, a laser light source for emitting high density energy light, e.g., laser beam, a laser head 24 including an image forming lens for adjusting a beam spot diameter of a laser beam, and the like, and a vertical scanning means 61 for moving the laser head 24 in the axial direction of the rotary drum 34 (vertical to the surface of the drawing paper).

The vertical scanning of the toner sheet 4 by the laser beam is based on the rotation of the rotary drum 34. In an alternative, the vertical scanning means 61 is not provided in the optical head 40. Moving means for producing an axial movement is provided in the rotary drum 34. The rotary drum 34 is axially moved while being rotated for the horizontal scan.

The laser light source may be any type of laser light source if it is capable of emitting high density energy light at such a high density as to realize the heat mode exposure. Examples of those laser light sources are a gas laser, such as an argon ion laser, a helium ion laser, or a helium cadmium laser, and a solid state laser, such as a YAG laser, a semiconductor laser, a dye laser, and an excima laser. A known modulation method may be used for the modulation of a laser beam by an image signal. In a case where the argon ion laser is used, a laser beam is passed through an external modulator. In a case where the semiconductor laser is used, current injected into the laser is controlled by a signal (direct modulation). A size of the laser spot converged on a photothermal conversion layer and a canning speed are determined depending on a resolution required for the image, a recording sensitivity of the material and others. For the printing use, a high resolution is generally required, and to secure good picture quality, it is preferable that the beam spot is small. In this case, however, the focal distance is small, and hence its mechanical control is difficult. When the scanning speed is too small, heat is transferred to the toner sheet support. This results in increase of the heat loss, and hence reduction of the energy efficiency and increase of the recording time. As seen from the foregoing description, for recording conditions in the invention, the beam diameter on the photothermal conversion layer is 5 to 50 $\mu$m, more preferably 6 to 30 $\mu$m, and the scanning speed is 1 m/sec. or higher, more preferably 3 m/sec. or higher.

An image signal is transferred, in the form of a digital signal, through an interface or the like to the control unit 51 from an image scanner located outside the image recording apparatus 30, an image processor, a work station (W/S) with a DTP function, an electronic publishing system, or various storage medium (magnetic tape, floppy disc, hard disc, RAM card or the like). Then, it is transferred to the optical head 40. In the optical head, the control of the heat mode type exposure by the laser head 24 is carried out.

The control unit 51 controls the vertical scanning operation by the vertical scanning means 61 of the optical head 40, the horizontal scanning operation of the rotary drum 34, the respective portions of the image recording apparatus 30, and controls an overall sequence of the apparatus operations.

The stripping-off mechanism 42 strips the toner sheet 4, which has a latent image formed through the heat mode exposure by the optical head 40, from the image receiving sheet 2, and at the same time transfers the latent image from the toner sheet 4 to the image receiving sheet 2, and develops the latent image. The stripping-off mechanism 42 is composed of a stripping-off roller 62, a couple of splitting rollers 63 and 64, which will be brought into contact with the stripping-off roller 62, a comb-like guide plate 65 provided between the split rollers, and a bracket (not shown) to which those are all mounted thereto. The stripping-off roller 62 is rotatably supported by an arm 67, and turns about a fulcrum 67*a* to touch and separate from the surface of the rotary drum 34. A pressing means 68 is provided which presses the stripping-off roller 62 against the laminate of the image receiving sheet 2 and the toner sheet 4 against the rotary drum 34, with the aid of the arm 67.

The arm 67 is turned about the fulcrum 67*a* to the laminate of the toner sheet 4 bearing a latent image thereon, which is formed in a manner that thermal energy is image-wise applied to the toner sheet and the bonding force of a toner layer 22 decreases, and the image receiving sheet 2 having an image receiving layer 16 to which the toner sheet is bonded. The bracket is moved to the laminate, and the comb-like guide plate 65 is inserted to between the image receiving layer 16 of the image receiving sheet 2 and the toner layer 22 of the toner sheet 4. The stripping-off roller 62 is put on the toner sheet 4 of the laminate and presses the laminate. In this case, if the bonding length of the toner sheet 4 or the image receiving sheet 2 is different from that of the other, the comb-like guide plate 65 can easily be inserted to between them. Thereafter, the rotary drum 34 is rotated, and in turn the stripping-off roller 62 and the splitting rollers 63 and 64 are rotated. The leading end of the toner sheet 4 is moved along the comb-like guide plate 65 and nipped between the stripping-off roller 62 and the splitting roller 63. In this way, the toner sheet 4 is pressed with the stripping-off roller 62, and it is transported while being nipped between the stripping-off roller 62 and the splitting rollers 63 and 64, whereby it is stripped from the image receiving sheet 2. In this way, the toner sheet 4 is stripped off at a fixed stripping speed at its portion pressed with the stripping-off roller 62. Therefore, the stripping force may be set at a fixed value. There is no chance that a vibration, such as a stick slip, occurs, and the toner sheet is nonuniformly stripped off. Further, in stripping off the toner sheet, the stripping force applied to the image receiving sheet 2 does not vary. Accordingly, the fixing position of the image receiving sheet 2 on the rotary drum 34 is immovable at its correct position. Accordingly, no registering accuracy degradation occurs. An image produced in this way is free from the uneven stripping-off and the out-of registering, and is a monochromatic dot image which is high in picture quality, resolution and high gradation.

In this way, the image receiving sheet 2, which has four color images of C, M, Y and K exactly aligned, has undergone the stripping-off, transfer and development processes, is transported to the laminating section 46 by a transporting roller pair 71, while being guided by guide members 70.

In the laminating section 46, a paper supplying roll 72 feeds paper H from a paper case 73 at the timing of the transportation of the image receiving sheet 2, and it is transported in the left direction as viewed in the drawing while being guided by the guide members 70. The paper H may be supplied to the paper supplying roll 72, from a manual insertion opening 44*a*. Then, the image receiving sheet 2 and the paper H are layered one on the other while being registered by a register roller pair 75, and transported to the fixing section 48.

Sometimes, the laminating section is separate from the image recording apparatus 30.

In the fixing section 48, the image receiving sheet 2 and the paper H, which are laminated together in the laminating section 46, are heated and fixed, and nipped and transported by a heating/fixing roller pair 76, which consists of a pressure roller 76*a* and a heating roller 76*b*. Further, the image receiving sheet 2 is hardened by a post-exposure lamp 77, such as an ultraviolet rays lamp, so that the image receiving layer 16 is easily stripped off.

This fixing process may be eliminated when some types of the recording media 2 (4) are used.

In the stripping-off section 50, the image receiving layer 16 which has been hardened and easy to be stripped off, is stripped off the image receiving sheet 2 with the aid of a stripping-off roller pair 78 and a stripping-off guide 79. The image receiving layer 16 is stuck to the paper H, so that an image is transferred to the latter. The paper H having the image transferred thereto is discharged, as a hard copy, into the proof tray 52*a* of the tray section 52. The image receiving sheet 2 from which the image receiving layer 16 was removed is cast into the used-member stacker 52*b*.

A structure of the recording medium 2 or 4 to be set to the image recording apparatus 30 will be described with reference to FIG. 9. FIG. 9 is a cross sectional view showing a structure of the recording medium 2 (4). FIG. 9A shows the structure of the recording medium 2 (4) of a heat mode type. FIG. 9B shows a structure of the recording medium 2 (4) of a photon mode type. An actual recording process for the image receiving sheet 2 (4) is carried out using a heat transfer sheet which forms the recording medium 2 (4) of the heat mode type shown in FIG. 9A. A toner sheet 4 of the heat mode type is formed with a "support", a "photothermal conversion layer", and a "toner layer", which are layered in this order when counted from the laser beam irradiation side. The image receiving sheet 2 is formed with a "image receiving layer", a "cushion layer", and a "support". The toner sheet 4 is layered on the image receiving sheet 2 in a state that its toner layer is directed to the image receiving sheet 2. In this state, laser light is irradiated onto the structure, and then a portion of the toner layer which is irradiated with the laser light is transferred to the image receiving layer by heat.

A recording medium 2 (4) of the photon mode type, which is used by the image recording apparatus 30, will be described with reference to FIG. 9. FIG. 9 is a cross sectional view showing a structure of the recording medium 3 (4). FIG. 9A shows a structure of a recording medium 2 (4) of the heat mode type. FIG. 9B shows a structure of a recording medium 2 (4) of the photon mode type. A support of the toner sheet 4 of the heat mode type shown in FIG. 9A is made of a material permitting laser light to transmit therethrough, such as PET (polytethylene terephthalate) base, TAC (triacetyl cellulsoe) base or PEN (polytethylene naphthlate) base. The photothermal conversion layer is made of a material for efficiently converting laser energy into heat, such as carbon, black matter, infrared rays absorbing dye, or specific-wavelength absorbing material. Toner sheets of various colors may each be used for the toner layer. Those colors are K (black), C (cyan), M (magenta), and Y (yellow). Gold, silver, brown, gray, green and orange are also used sometimes. The heating characteristic and the recording characteristic vary for each color.

The image receiving layer of the image receiving sheet 2 receives toner to be transferred. Where a plurality of toner layers are layered one on the other, the cushion layer absorbs the difference between the adjacent toner layers.

The structures of the recording media 2 and 4 of the heat mode type vary from use to use. For the details of the toner sheet and the image receiving sheet, reference is made to JP-A-4-296594, JP-A-4-327982, and JP-A-4-327983. For the apparatus using the recording media, reference is made to JP-A-7-290731.

FIG. 8 is a diagram showing a sequence of steps of recording an image for each of colors of K, C, M and Y into the image receiving sheet 2 of the heat mode type shown in FIG. 9A. Each of the recording processes of K, C, M and Y colors consists of a laminating step, a step of recording color data by laser light, and a step of stripping off the toner sheet 4 from the image receiving sheet 2, which follows the recording step.

Step 1: to wind the image receiving sheet 2 on the rotary drum 34 (FIG. 8A).

Step 2 to wind a K color toner sheet on the image receiving sheet in order to execute a K recording step (FIG. 8B).

Step 3: if necessary, to laminate the K color toner sheet on the image receiving sheet by a rotary roller a part of which is illustrated (FIG. 8C).

Step 4: to irradiate laser light on the image receiving sheet in accordance with an image/character data of color K (FIG. 8D).

Step 5: to strip the K color toner sheet from the image receiving sheet, and to end the K process (FIG. 8E).

Step 6: to execute a C process as in the K process. To wind the C color toner sheet on the image receiving sheet.

Step 7: to laminate the C color toner sheet on it, if necessary.

Step 8 to record data of the color C by the laser light.

Step 9 to strip the C color toner sheet from the image receiving sheet, and to end the C process.

Step 10: to execute an M process in a similar manner. To wind an M toner sheet on the image receiving sheet.

Step 11 to laminate the M color toner sheet on it, if necessary.

Step 12: to laser record the M color data

Step 13: to strip the M color toner sheet from the image receiving sheet and to end the M process.

Step 14: to execute a Y process. To wind a Y color toner sheet on the image receiving sheet.

Step 15: to laminate the Y color toner sheet on it, if necessary.

Step 16: to laser record Y color data by laser light.

Step 17: to strip the Y color toner sheet from the image receiving sheet 2 and to end the Y process.

Step 18: through the execution of those steps, K, C, M, Y colors are selectively layered to form a necessary color image (FIG. 8F).

Thus, in the image recording apparatus 30, the recording media 2 and 4, which are formed in a manner that the toner sheet using toner, which can be thermally molten, bonded or sublimed, is laid on the image receiving sheet, are fixed on the rotary drum 34, and those are irradiated with a laser beam or the like to record color data of K, C, M, Y. While the recording media 2 and 4 of the heat mode type have been described, the image recording apparatus 30 and the recording process may be applied to the recording media 2 and 4 of the photon mode type to be described hereunder.

In FIG. 9B, the toner sheet 4 of the recording medium of the photon mode type is formed with a "support layer", a "photopolymerization layer", a "toner layer", and an "adhesive layer" in this order when counted from the laser radiation side. It suffices that those layers are layered in this order. Further, an intermediate layer, a protecting layer, an ultraviolet absorbing layer and the like may be provided, if necessary. The image receiving sheet 2 is formed with an "image receiving layer" and a "support layer".

For the "support layer", the "photopolymerization layer", the "toner layer", and the "adhesive layer" of the toner sheet 4, and the "image receiving layer" and "support layer" of the image receiving sheet, reference is made to JP 2000-267272 (unexamined patent), filed by the present patent applicant.

In the recording media 2 and 4 used in the image recording apparatus, the surface of each recording medium is not covered with a protecting sheet (referred to as a cover film). A recording medium covered with the cover film also exists, however. Structures of recording media 2' and 4', which are covered with such cover sheets, are shown in FIG. 6.

FIG. 6 is a cross sectional view showing structures of recording media of the photon mode type and the heat mode type. The recording media of FIG. 6 are similar, in structure, to those of FIG. 9. In the case of the recording media 2' and 4' of the heat mode type, the lower side of the toner layer of the toner sheet 4' and the upper side of the image receiving sheet 2' are covered with cover films 6, respectively. In the case of the recording media 2' and 4' of the photon mode type, the underside of the adhesive layer of the toner sheet 4' and the upper side of the image receiving layer of the image receiving sheet 2' are covered with cover films 6. A material of the cover film 6 is a nonadhesive material, such as a polyethylene film. When the cover film 6 is stuck onto the recording medium, the following advantages will be produced.

1) It never happens that when the image receiving sheets 2' of the photon mode type and the heat mode type are each rolled for storage, the image receiving sheet will stick onto the back side of the support because the self-bonding and adhesion properties of the image receiving sheet act.
2) It never happens that when the toner sheet 4' of the recording medium of the photo mode is rolled for storage, the adhesive layer will stick to the back side of the support because the self-bonding and adhesion properties of the adhesive layer containing wax compound act. Further, there is no case that dust will stick to the wax material because the self-bonding and adhesion properties of the adhesive layer act.
3) When the toner sheet 4' of the recording medium of the heat mode type is handled, the toner layer is prevented from being flawed or being marked with a fingerprint. Those flaw and fingerprint will cause a defect of the final image.

The recording medium of the heat mode type may be used in an illumination environment, for example, in a white bright room or a light room, a yellow color room, and a dark room. The recording medium of the photon mode type may be used in an illumination environment, for example, in the yellow color room and the dark room. When it is used in the light room, the image recording apparatus needs some light shielding means to shield it against light since its recording sensitivity is high.

SUMMARY OF THE INVENTION

When the recording medium covered with the cover film is used, use of the conventional image recording apparatus shown in FIG. 4 is rejected by the following reason. When the recording medium 2' (4') covered with the cover film 6 is rolled and set in the recording medium station 53 of the image recording apparatus 30 shown in FIG. 7, the cover film 6 is not stripped off the recording medium 2' (4') when it is transported. The image receiving layer and the toner layer, as the active surfaces, of the recording media 2' and 4' are transported while being covered with the cover films 6. As a result, the apparatus fails to record an image thereon. For this reason, when the recording media 2' and 4' covered with the cover films 6 are used, the transporting section for transporting the recording medium 2' (4') from the recording medium station 53 to the rotary drum 34 is not used, and the cover films 6 must be stripped off the recording media 2' and 4' manually, and then set onto the rotary drum 34 also manually. How to manually strip off the cover film 6 will be described hereunder.

The recording media 2' and 4' are attracted and fixed, by suction, onto the rotary drum 34 by means of a suction mechanism of the rotary drum 34 of the image recording apparatus 30 shown in FIG. 7. Then, a corner of the cover film 6 that is fixed, by suction, to the rotary drum is slightly stripped off the surface of each recording medium 2' (4') with the nail of the operator's fingertip, and an exposed part of the recording medium is fixed by the recording-medium fixing/releasing mechanism 36. Then, the turned up part of the cover film 6 is picked up between the operator's fingers, and then the cover film is stripped off when the recording medium 2' (4') is small. When the recording medium 2' (4') is small, the operator strips off the upper side or the lower side of the recording medium by a length of about 10 to 20 mm; he holds the stripped off part of the recording medium by one hand; and in this state, he turns the rotary drum 34 by the other hand, and strips off the cover film 6.

In another way of stripping off the cover film, the recording medium 2' (4') covered with the cover film 6 is placed on a flat surface, e.g., a table. The cover film 6 is completely stripped off the recording medium 2' (4'), and then the recording medium is fixed to the rotary drum 34.

As described above, the conventional image recording apparatus cannot record an image by using the recording media 2' and 4' covered with the cover films 6. Accordingly, the operator must strip off the cover films 6 manually. For this reason, during the work of stripping the cover films 6 from the recording media, dust floating in the room or fibers emitted from the operator's clothes attach to the surfaces of the recording media 2 and 4. As a result, the final image suffers from defects.

For the above background reasons, the present invention has an object to provide an image recording apparatus which can use the recording media 2' and 4' covered with the cover films 6.

To achieve the above object, there is provided an image recording apparatus in which a toner sheet is layered on a image receiving sheet, and toner is transferred from the toner sheet onto the image receiving sheet by applying light or heat to the toner sheet, the improvement being characterized by protecting sheet winding-up means for winding up a protecting sheet which covers the surface of the resistor and/or the toner sheet.

In the image recording apparatus, the protecting sheet winding-up means includes a winding-up shaft located near each sheet set portion of the image receiving sheet and the toner sheet, and winding-up shaft drive means for driving the winding-up shaft.

In the image recording apparatus, the winding-up shaft drive means is a torque motor or a gear for winding up the protecting sheet at a given torque.

In the image recording apparatus, the winding-up shaft drive means also drives medium setting shafts to which the image receiving sheet and/or the toner sheet is set, and a difference of the number of revolutions between the medium setting shaft and the winding-up shaft is selected such that an amount of the protecting sheet wound up with the winding-up shaft is always somewhat larger than an amount of the protecting sheet as fed even if the diameter of the roll of each of the image receiving sheet and the toner sheet, which are set to each medium setting shaft, take any value.

The image recording apparatus further comprises: the winding-up shaft drive means and medium setting shaft drive means for driving the medium setting shafts, wherein the number of revolutions or a revolution speed of the winding-up shaft drive means is controlled in accordance with an amount of sheet fed out of the medium setting shaft and a revolution speed of the medium setting shaft.

In the image recording apparatus, the protecting sheet winding-up means includes protecting sheet end attracting means which is disposed close to a cutter for cutting the image receiving sheet and the toner sheet.

In the image recording apparatus, the protecting sheet end attracting means includes a hollowed pipe having a plurality of holes, the hollowed pipe being oriented in the direction perpendicular to a sheet transporting direction, and sucking means for sucking air from the inside of the hollowed pipe.

BRIEF DESCRIPTION OF THE DRAWINGS

FIG. 6 is a cross sectional view showing structures of recording media with the cover films 6 stuck thereto.

FIG. 9 is a cross sectional view showing structures of recording media.

DESCRIPTION OF THE PREFERRED EMBODIMENTS

Figure 1:
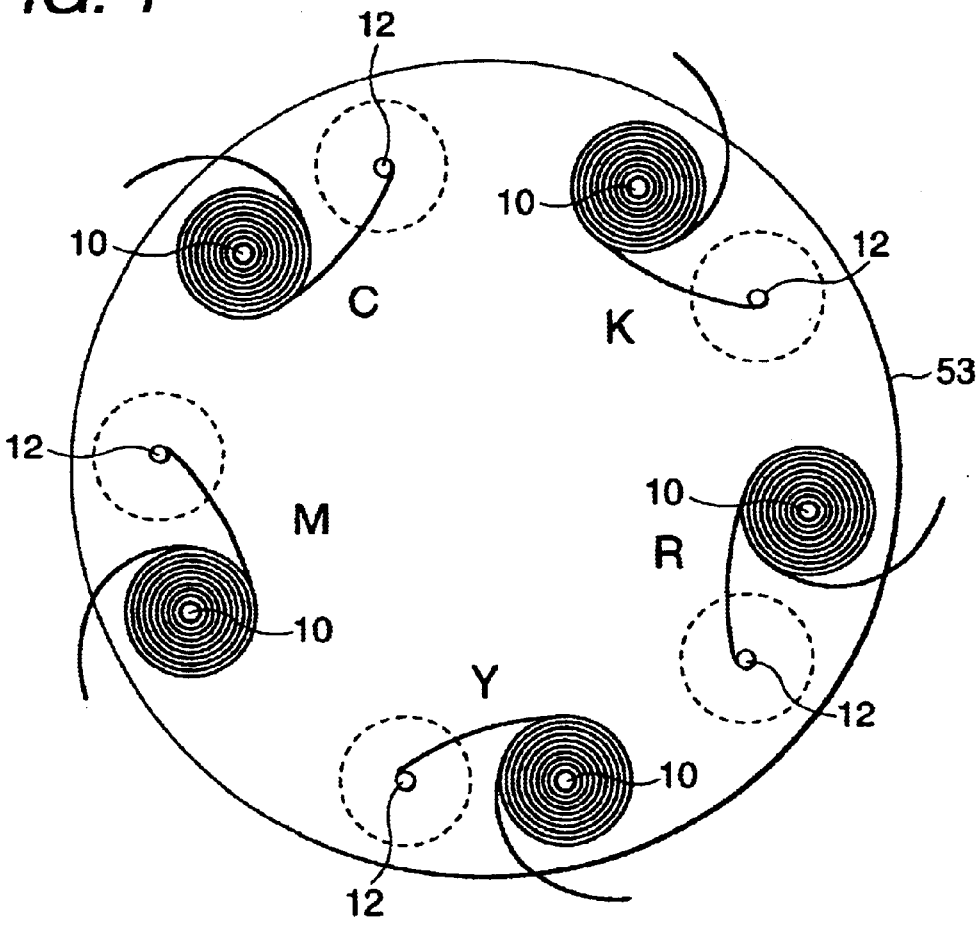
FIG. 1 shows an arrangement of a recording medium station in an image recording apparatus which is a first embodiment of the present invention.

FIG. 1 shows an arrangement of a recording medium station 53 in an image recording apparatus which is a first embodiment of the present invention. The recording medium station 53 includes sheet set portions and cover film winding-up portions located close to the sheet set portions. Rolls of toner sheets covered with protecting sheets (referred to as cover films) (of colors C, K, M, Y) and rolls of image receiving sheets 2' covered with cover films 6 are set in the sheet set portions. The sheet set portions and the cover film winding-up portions are disposed along the circumferential outer surface of the recording medium station 53. Each sheet set portion contains a shaft 10 (referred to as a medium setting shaft 10) to which rolled recording media are applied. Each cover film winding-up portion contains a shaft 12 (referred to as a winding-up shaft 12) for winding up the cover film 6.

A method of winding up the cover film 6, which is executed in the recording medium station 53 thus constructed, will be described with reference to FIG. 1.

Rolled recording media are set to the medium setting shafts 10 in the recording medium station 53. The end of the cover film 6, which is slightly stripped from the recording medium set to each medium setting shaft 10, is drawn out and fixed to the winding-up shaft 12. A method of fixing the cover film 6 to each of the winding-up shafts 12 is to fix the leading end of the stripped cover film 6 to the winding-up shaft 12 by means of adhesive tape or the like. Another method is to insert the leading end of the stripped cover film 6 into a groove or cutout of the winding-up shaft 12. Yet another method is to fix the leading end of the stripped cover film 6 to the winding-up shaft 12 by using an adhesive material.

Then, the cover film 6 stripped off the recording medium set to the related medium setting shaft 10 is wound up through the rotation of the winding-up shafts 12. When the recording medium set to the medium setting shaft 10 is a new or almost new one, the amount of the recording medium is large. Accordingly, the diameter of the rolled recording medium set to the medium setting shaft 10 is large, while the diameter of the rolled cover film 6 set to the winding-up shaft 12 is small. Accordingly, when a predetermined amount of the recording medium is fed out of the rolled recording medium set to the medium setting shaft 10, the number of revolutions of the winding-up shaft 12 increases relative to the number of revolutions of the medium setting shaft 10. When the amount of the recording medium set to the medium setting shaft 10 is small, the diameter of the rolled recording medium set to the medium setting shaft 10 is small, while the diameter of the cover film 6 set to the winding-up shaft 12 is large. For this reason, when a predetermined amount of recording medium is fed out of the medium setting shaft 10, the number of revolutions of the winding-up shafts 12 decreases relative to the number of revolutions of the medium setting shaft 10. This problem, however, is solved by a cassette tape winding-up mechanism to be described hereunder.

1) The winding-up shafts 12 are driven by a torque motor and gears, and the cover film 6 is wound up at a predetermined torque, while the recording medium on the medium setting shaft 10 is not rotated by the motive power of the winding-up shaft 12.

2) The medium setting shafts 10 and the winding-up shafts 12 are driven by use of drive motors, belts and others. A difference of the number of revolutions between the medium setting shaft 10 and the winding-up shaft 12 is selected such that an amount of the cover film wound up with the winding-up shaft 12 is always large even if the diameter of the roll of the recording medium set to each medium setting shaft 10 takes any value. A mechanical means capable of controlling the torque, such as a torque limiter, is located between the winding-up shaft 12 and the drive belt, whereby the winding-up quantity of it is controlled. The medium setting shafts 10 and the winding-up shafts 12 are coupled with drive motors, and the number of revolutions or the rotating speed of each winding-up shaft 12 are controlled in accordance with a quantity of the recording medium as fed or a rotational speed of the medium setting shafts 10.

3) The recording medium from which the cover film 6 is stripped by the winding-up shaft 12, viz., only those sheets, the image receiving sheet 2 and the toner sheet 4, are supplied onto the rotary drum 34.

Thus, the cover film 6 is mechanically wound up from the recording medium 2' (4') by means of the winding-up shaft 12. Accordingly, there is no case that fiber dust which will possibly be generated from the clothes of the worker when he strips the cover film 6 from the recording medium 2' (4') attaches to the recording medium. As a result, the final image is free from an image defect which results from the dust attached to the recording medium.

Further, the recording medium 2' (4') with the cover film 6 stuck thereto is automatically transported and stripped off. This feature eliminates such a troublesome work that the worker manually strips off the film 6 from the recording medium 2' (4'). This leads to labor cost and labor saving, and hence improvement of the productivity.

In the above-mentioned embodiment, if the recording medium of the photon mode type is set to the image recording apparatus having no light shielding function, and the apparatus is operated in an illumination environment of a light room, there is a danger that the recording medium of the photon mode type is exposed to light since the recording medium of the photon mode type has a high recording sensitivity.

Figure 2:
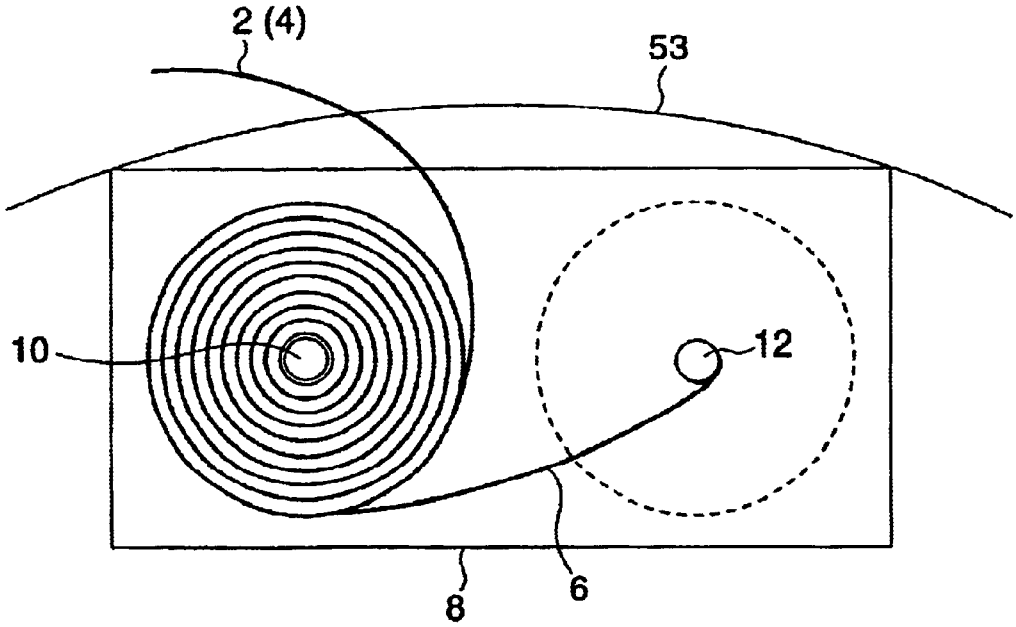
FIG. 2 is an enlarged view showing a cover film winding-up portion located within a cassette, which is another embodiment of the invention.

Accordingly, in another embodiment, the cover film winding-up portion in the first embodiment may be housed in a cassette 8. FIG. 2 is a diagram showing a part of the recording medium station 53 in which the cover film winding-up portion is provided within the cassette 8, which is another embodiment. In FIG. 2, like or equivalent portions are designated by like reference numerals in FIG. 1. Each cover film winding-up portion is confined within the cassette 8, and includes medium setting shafts 10 and winding-up shafts 12 to which recording media 27 and 4' are set. Those cover film winding-up portions are equidistantly disposed along the circumferential outer surface of the recording medium station 53. When the recording medium of the heat mode type is used, the cassette 8 containing the recording media may be made of transparent plastic or glass. When the recording medium of the photon mode type is used, it is made of a light shielding material in order to prevent its exposure to light.

The winding up of the cover film 6 carried out in the cover film winding-up portion thus constructed, which is the present embodiment, will briefly be described with reference to FIG. 2.

The cover film 6 is wound up with the winding-up shaft 12 while the cover film 6 is stripped off the recording medium 2' (4') set to the medium setting shaft 10 within the cassette 8. And the recording medium 2 (4) from which the cover film 6 is stripped, viz., the image receiving sheet 2 (toner sheet 4), is fed out of the cassette 8 and onto the rotary drum 34. Thereafter, the recording process shown in FIG. 8 is carried out.

Since the cover film 6 is automatically wound up from the recording medium 2' (4') with the winding-up shafts 12 within the cassette 8, the user can use the recording media 2' and 4' with the cover films 6 stuck thereto without being conscious of the presence of the cover films 6. Further, the used cover films 6 as waste materials are wound up within the cassette 8. This fact makes it easy to gather the used cover films 6. Additionally, in the manufacturing stage, the leading end of the cover film 6 is fixed to the winding-up shaft within the cassette 8. Therefore, there is no need of the work by the user which fixes the cover film 6 to the winding-up shaft. Furthermore, since the recording media are housed in the cassette 8, there is no chance that the recording medium of the photon mode type is exposed to light even in a light room.

In the embodiment mentioned above, the cover film winding-up portion is discussed in which the medium setting shafts 10 to which the rolled recording media 2' and 4' are set, and the winding-up shafts 12 are housed in the cassette 8. A mechanical arrangement in which only the rolled recording media 2' and 4' are housed in the cassette 8 may be presented for still another embodiment.

Figure 3:
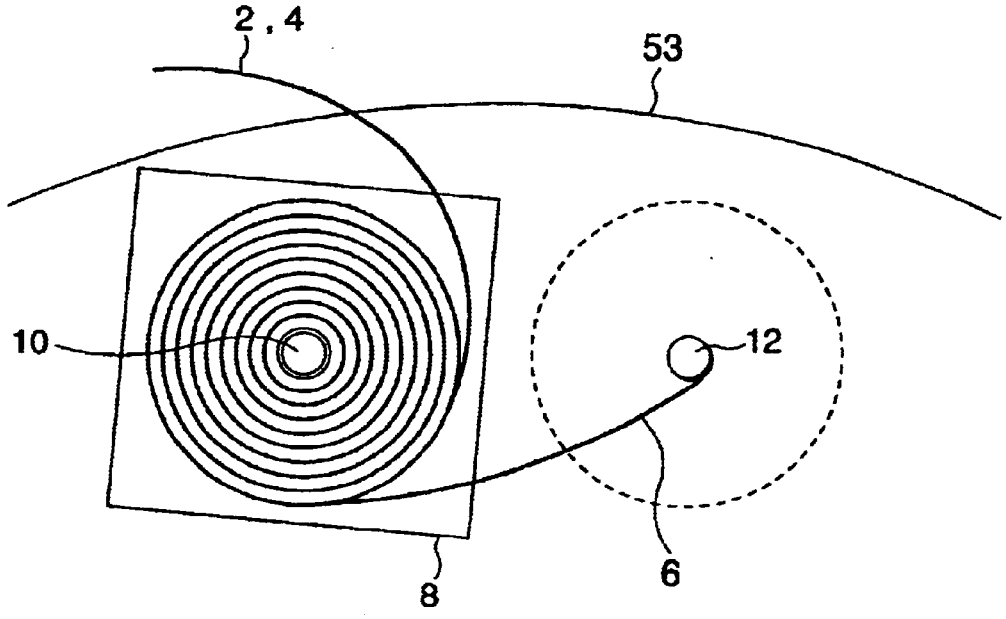
FIG. 3 is a diagram showing a cover film winding-up portion in which recording media are disposed within a cassette, which is yet another embodiment of the invention.

FIG. 3 is a diagram showing a recording medium station 53 according to yet another embodiment of the invention. In FIG. 3, like or equivalent portions are designated by like reference numerals in FIGS. 1 and 2. In the embodiment, the recording medium station 53 includes a cover film winding-up portion having a cassette 8 in which recording media 2' and 4' are contained. The cassette 8 includes medium setting shafts 10 to which the rolled recording media 2' and 4' are set, and it is set to a predetermined location in the recording medium station 53. In the recording medium station 53, winding-up shafts 12 are provided in association with the cassettes 8. The cover film winding-up portions are equidistantly disposed along the circumferential outer surface of the recording medium station 53.

The winding up of the cover film 6, which is carried out in each cover film winding-up portion thus constructed of the embodiment, will briefly be described with reference to FIG. 3.

The cover film 6 is wound up with each winding-up shaft 12 while the cover film 6 is stripped off the recording medium 2' (4') that is set to the medium setting shafts 10 within the cassettes 8, and the recording media 2 and 4 from which the cover films 6 have been stripped are fed out of the cassettes 8. And the recording media 2 and 4 from which the cover films 6 have been stripped, viz., the image receiving sheet 2 and the toner sheet 4, are fed onto the rotary drum 34.

Thus, the recording media 2' and 4' are housed in the cassettes 8, and the cover films 6 are automatically wound up from the recording media 2' and 4' with the winding-up shafts 12. Accordingly, there is no chance that the recording media are scratched and marked with fingerprints, and that the recording media are loosened within the cassettes 8. If the user carelessly drops the recording media, the recording media are not deformed since those are contained in the cassettes 8. Since the recording media are housed within the cassette 8, the recording media is little exposed to the open air. Accordingly, there is less chance that foreign matter attaches to the recording media. An amount of foreign matter, which attaches to the recording media and enters the image recording apparatus, is remarkably reduced. As a result, a chance that the foreign matter makes the final image defective is considerably reduced.

The recording media to be put in the cassettes 8 may be of the heat mode type. When the recording medium of the heat mode type is used, the cassettes 8 which receive the recording media may be made of transparent plastic or glass. When it is of the photon mode, a material having a light shielding function is preferably used in order to prevent its exposure to light.

In the first embodiment, when a plurality of recording media are set to the recording medium station 53, it is necessary to use the winding-up shafts 12 which are equal in number to the recording media.

Figure 4:
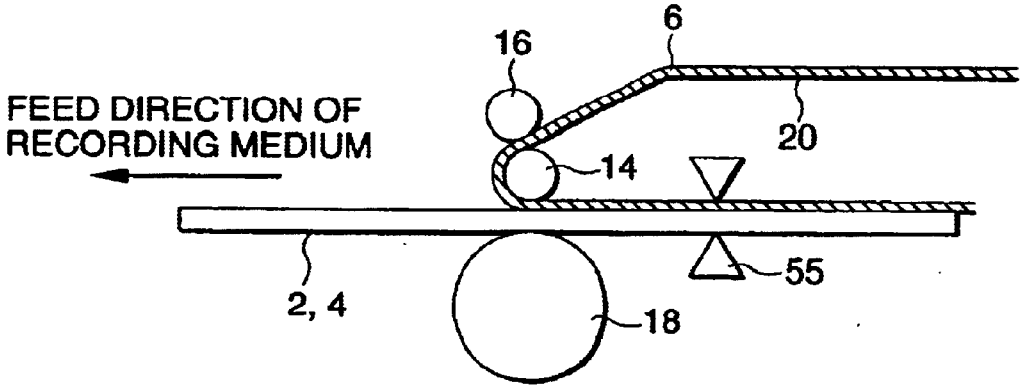
FIG. 4 is a diagram showing a cover film winding-up portion assembled into an image recording apparatus of a second embodiment of the invention.

FIG. 4 is a diagram showing a cover film winding-up portion assembled into an image recording apparatus of the second embodiment.

Figure 5:
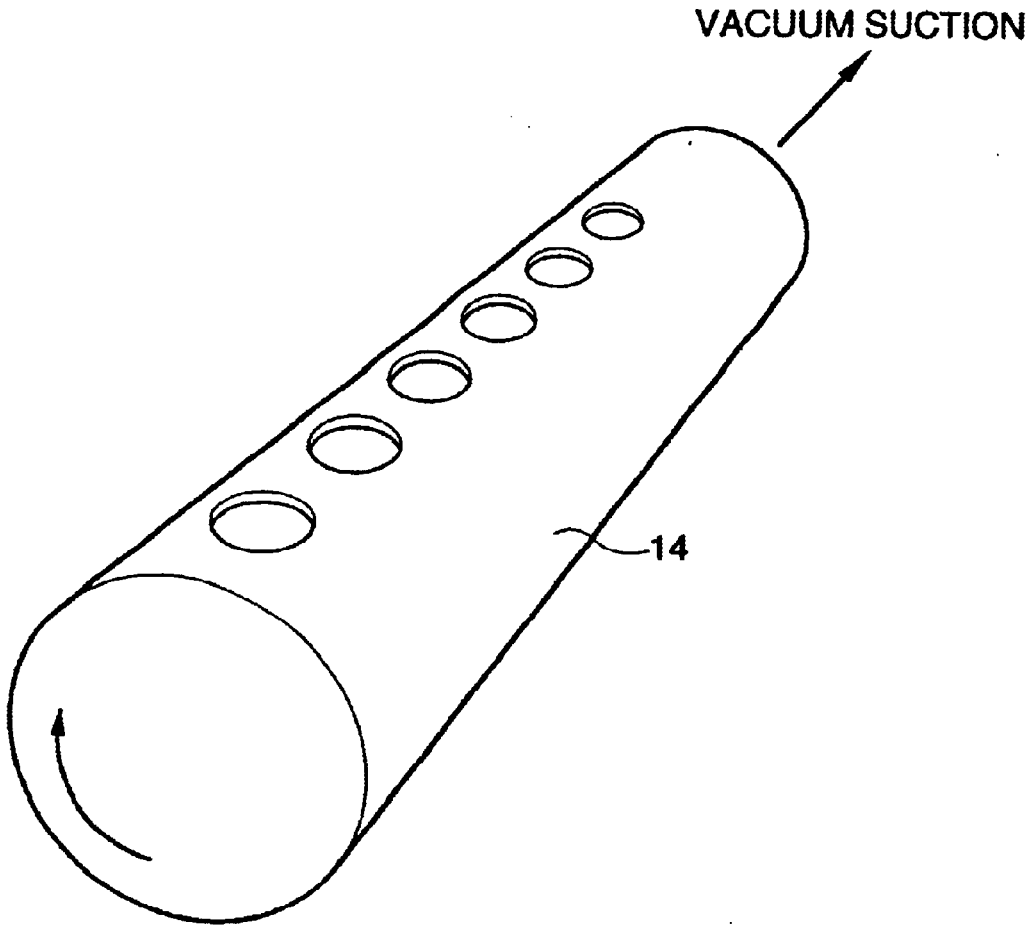
FIG. 5 is an enlarged view showing a suction roller contained in the cover film winding-up portion.
Figure 6B:
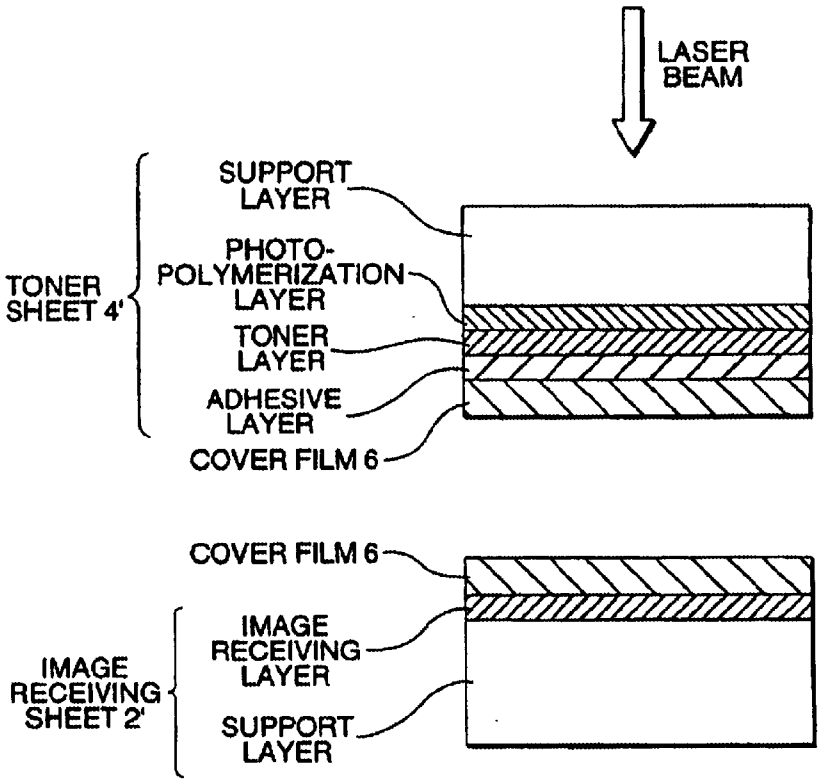
FIG. 6B shows a structure of a recording medium of the photon mode.
Figure 6A:
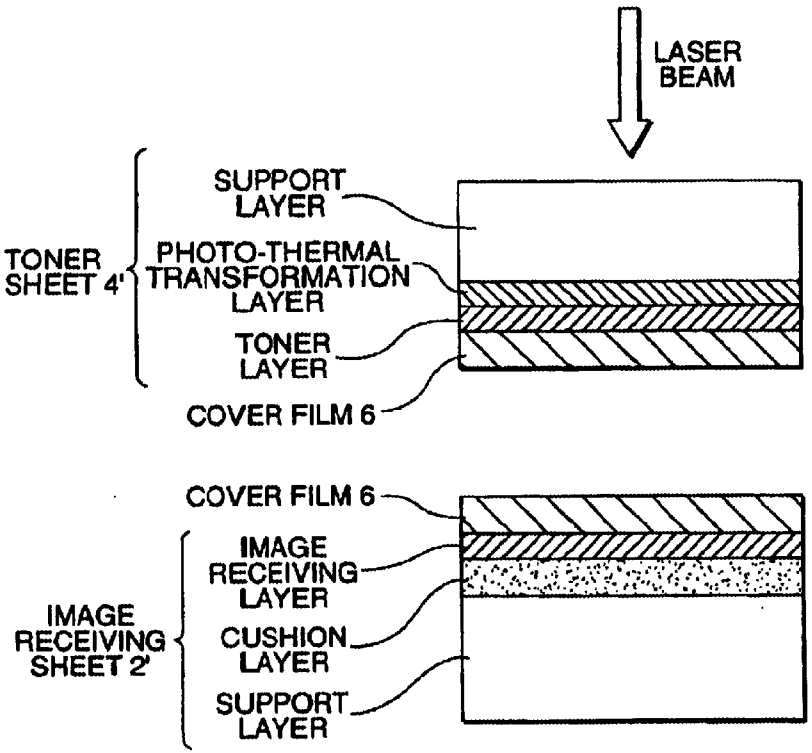
FIG. 6A shows a structure of a recording medium of the heat mode type.
Figure 7:
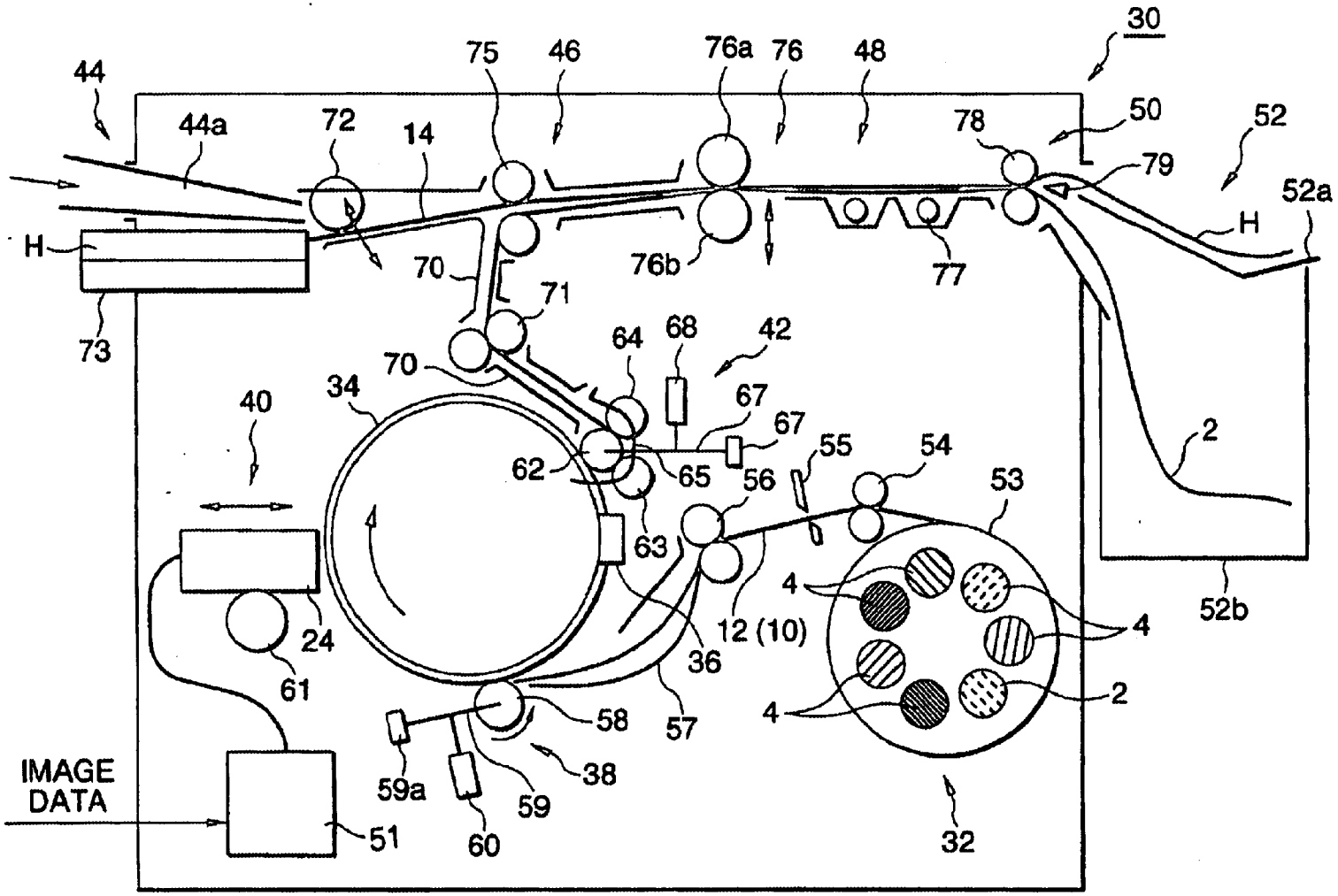
FIG. 7 is a diagram schematically showing a conventional image recording apparatus.
Figure 8A:
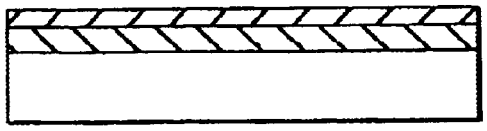
FIG. 8 is a diagram showing a sequence of steps of recording colors of K, C, M and Y into the image receiving sheet shown in FIG. 6.
Figure 8B:
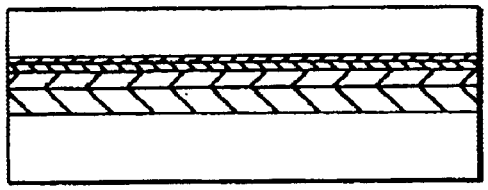
Figure 8C:
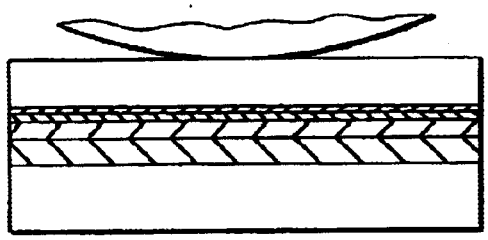
Figure 8C:
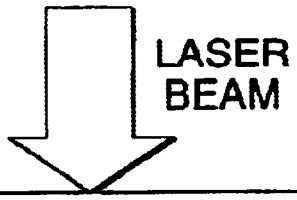
Figure 8D:
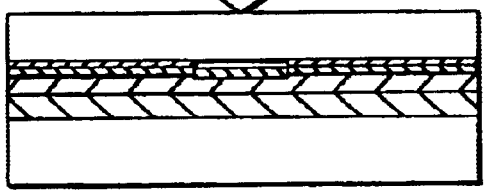
Figure 8E:
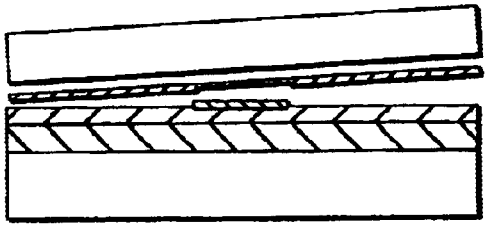
Figure 8E:
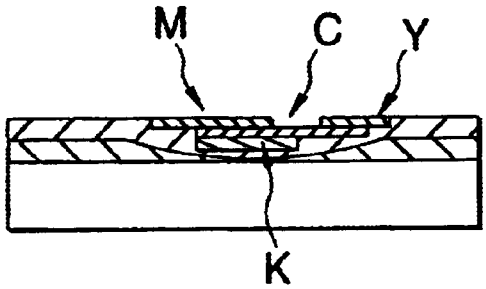
Figure 9B:
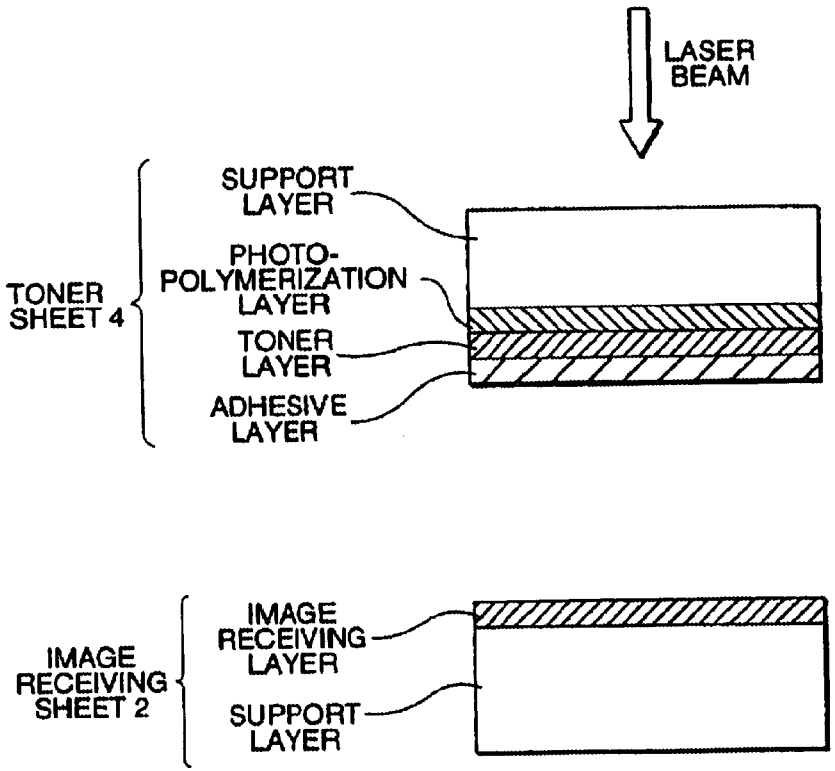
FIG. 9B shows a structure of the recording medium of a photon mode type.
Figure 9A:
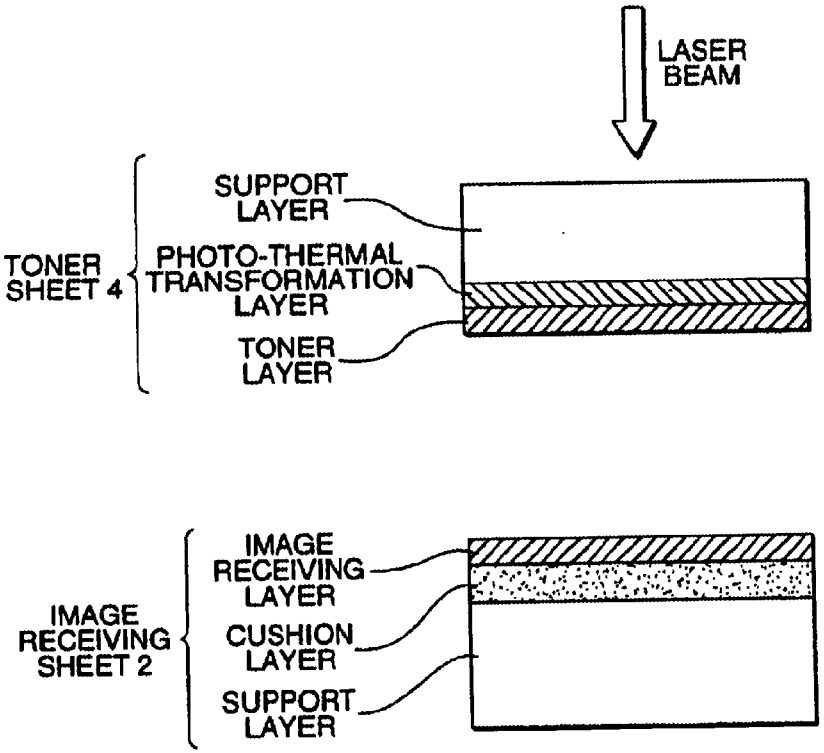
FIG. 9A shows a structure of the recording medium of a heat mode type.

The cover film winding-up portion of the present embodiment is located downstream of the cutter 55 as viewed in the transporting direction of the recording medium 2' (4'). The cover film winding-up portion is made up of a transport roller 18 for transporting the recording media 2' and 4', a roller 14 having suction holes (referred to as a suction roller 14), a roller 16 (referred to as a follower roller 16) which rotates following the rotation of the suction roller 14, and a cover film guide 20 for transporting the stripped cover film 6. The transport roller 18 is rotated by a motor or the like at a revolution speed which is equal to the recording medium transporting speed. The suction roller 14 is vertically movable, and as shown in FIG. 5, suction holes are linearly arrayed in the surface of the suction roller 14. FIG. 5 is an enlarged view showing the suction roller 14 contained in the cover film winding-up portion. At least one end of the suction roller 14 has a hollowed structure which may be coupled to a suction source. The suction source may be a vacuum pump or a blower. The follower roller 16 is in contact with the suction roller 14 even when it vertically moves, and rotates following the suction roller 14. A suction force acting between the cover film 6 and the suction roller 14 is stronger than a bonding force acting between the recording medium 2 (4) and the cover film 6. For this reason, there is no chance that during a suction/attracting operation to be given later, the cover film 6, together with the recording medium 2' (4'), is transported to the cover film guide 20.

A winding up process of winding up a cover film in the cover film winding-up portion of the second embodiment of the invention will be described with reference to FIG. 4.

Step 1 to rotate the suction roller 14 to direct its surface having the suction holes to the transport roller 18 (downward in the drawing).

Step 2 to move the suction roller 14 apart from the transport roller 18 (upward in FIG. 4), and to disengage the suction roller 14 from the transport roller 18.

Step 3: to transport the leading end of the recording medium with the cover film 6 stuck thereto, which is supplied from the recording medium station 53, to a position under the suction holes of the suction roller 14. More specifically, when in the next step, the suction roller 14 is moved to the transport roller 18, the leading end of the recording medium 2' (4') with the cover film 6 attached thereto is transported to a position where it closes the suction holes of the suction roller 14.

Step 4: to move the suction roller 14 to the transport roller 18 (downward in FIG. 4) to bring the suction roller 14 into contact with the recording media 2' and 4' with the cover films 6 attached thereto.

Step 5: to attract the cover film 6 to the suction roller 14 by use of a vacuum pump or a blower, and to turn the transport roller 18 and the suction roller 14 to the direction in which the recording media 2' and 4' are to be transported in a state that the cover film 6 is attracted, by suction, to the suction roller 14. The cover film 6 is stripped off the recording medium 2' (4'), and nipped between the suction roller 14 and the follower roller 16, and only the recording media 2 and 4 are transported in the medium transporting direction. A roller with a suction mechanism may be used instead of the transport roller 18.

Step 6:to stop the suction operation of the vacuum pump or the blower, and to wait till that the suction pressure for attracting the cover film 6 of the suction roller 14 is equal to the atmospheric pressure.

Step 7: to rotate again the transport roller 18, the suction roller 14, and the follower roller 16 to the direction of transporting the recording medium 2 (4), and transport the recording medium 2 (4) to the rotary drum 34. Thereafter, the recording process shown in FIG. 8 is carried out. Further, the cover film 6 is transported to a storage portion within the image recording apparatus or discharged out of the image recording apparatus, through a predetermined transporting path.

The recording medium of the heat mode type may be used in every illumination environment. The recording medium of the photon mode is high in recording sensitivity. Accordingly, when the illumination environment is a light room, the image recording apparatus must include some light shielding means in order to prevent its exposure to light. When the illumination environment is a yellow color room or a dark room, the recording medium of the photon mode may be used.

Thus, the cover film 6 is automatically wound up from the recording medium 2' (4') by use of the suction roller 14 and the follower roller 16. Accordingly, dust, e.g., fiber dust which will possibly be produced from the clothes of a worker when he strips the cover film 6 from the recording medium, is prevented from attaching to the recording medium. As a result, the defect of the final image, which is due to the dust attaching to the recording medium, is not formed. Since the recording medium with the cover film 6 stuck thereto is automatically transported and stripped, there is eliminated the troublesome work by the worker to manually strip the cover film 6 from the recording medium. This results in reduction of labor costs and labor saving, and increase of the productivity. In the image recording apparatus of the first embodiment of the invention, a plurality of recording media are set in the recording medium station 53. Accordingly, the wind-up shafts 12 which are equal in number to the recording media are required. The image recording apparatus of the second embodiment does not need the wind-up shafts 12. Therefore, the space saving is realized.

As seen from the foregoing description, the image recording apparatus of the invention executes the process that the worker otherwise would carry out. Accordingly, the image recording apparatus is free from the final image defect which is due to dust or fiber dust generated from the clothes of the worker during the work by the worker.

Further, the recording medium with the cover film 6 stuck thereto is automatically transported, and the cover film 6 is automatically stripped. Therefore, there is eliminated troublesome work by the worker to manually stripe the cover film 6 from recording medium. This results in reduction of labor cost and labor saving, and as a result, the image recording apparatus improved in productivity is provided.

What is claimed is:

1. An image recording apparatus in which a toner sheet is layered on an image receiving sheet, and toner is transferred from said toner sheet onto said image receiving sheet by applying light or heat to said toner sheet, the improvement being characterized by protecting sheet winding-up means for winding up a protecting sheet which covers the surface of at least one of said image receiving sheet said toner sheet, wherein said toner and said image receiving sheets are set in sheet set portions, and, wherein said protecting sheet winding-up means comprises a winding-up shaft located near at least one sheet set portion of said image receiving sheet and said toner sheet, and winding-up shaft drive means for driving said winding-up shaft, wherein said winding-up shaft drive means also drives medium setting shafts to which said image receiving sheet and/or said toner sheet is set, and a difference of the number of revolutions between said medium setting shaft and said winding-up shaft is selected such that an amount of said protecting sheet wound up with said winding-up shaft is always somewhat larger than an amount of said protecting sheet as fed even if the diameter of the roll of each of said image receiving sheet and said toner sheet, which are set to each said medium setting shaft, take any value.

2. An image recording apparatus according to claim 1, wherein said winding-up shaft drive means is a torque motor or a gear for winding up said protecting sheet at a given torque.

3. An image recording apparatus according to claim 1, wherein the number of revolutions or a revolution speed of said winding-up shaft drive means is controlled in accordance with an amount of sheet fed out of said medium setting shaft and a revolution speed of said medium setting shaft.

4. An image recording apparatus according to claim 1, further comprising a cutter, wherein said protecting sheet winding-up means comprises a protecting sheet end attracting means which is disposed close to said cutter for cutting said image receiving sheet and said toner sheet.

5. An image recording apparatus according to claim 4, wherein said protecting sheet end attracting means comprises a hollowed pipe having a plurality of holes, said hollowed pipe being oriented in the direction perpendicular to a sheet transporting direction, and sucking means for sucking air from the inside of said hollowed pipe.

* * * * *